US006523219B1

(12) United States Patent
Anderson

(10) Patent No.: US 6,523,219 B1
(45) Date of Patent: Feb. 25, 2003

(54) WINDOW SCRAPER GUIDE

(76) Inventor: Maryann Helen Anderson, 343 Shailer Hill Rd., Colchestor, CT (US) 06415

( * ) Notice: Subject to any disclaimer, the term of this patent is extended or adjusted under 35 U.S.C. 154(b) by 39 days.

(21) Appl. No.: 09/668,074

(22) Filed: Sep. 22, 2000

(51) Int. Cl.[7] ..... A47L 1/06
(52) U.S. Cl. ..... 15/257.01; 15/235.7; 15/236.09
(58) Field of Search ..... 15/235.7, 235.8, 15/236.05, 236.06, 236.09, 257.01

(56) References Cited

U.S. PATENT DOCUMENTS 2,616,285 A * 11/1952 Shields
2,893,042 A * 7/1959 Paskaly
3,045,271 A * 7/1962 Cinotti
4,080,684 A * 3/1978 Venditti
4,217,854 A * 8/1980 Brown
4,766,635 A * 8/1988 DeVitis

OTHER PUBLICATIONS

Andersen Corporation, Double–Hung Window Installation for Andersen Narroline and Tilt–Wash Windows. 1997.

* cited by examiner

*Primary Examiner*—Terrence R. Till
(74) *Attorney, Agent, or Firm*—McCormick, Paulding & Huber LLP

(57) ABSTRACT

A window scraper guide has a base with a first straight edge disposed between an upper surface and an opposing lower surface. A pair of sides extend perpendicularly rearward a first predetermined distance from the first straight edge. The distance between the upper surface and opposing lower surface is a second predetermined distance. A side shield extends upwardly from one side of the pair of sides, and the side shield has a second straight edge aligned with the first straight edge. A handle portion extends at a predetermined angle from the lower surface of the base.

8 Claims, 3 Drawing Sheets

WINDOW SCRAPER GUIDE

FIELD OF THE INVENTION

The present invention relates generally to devices for staining and painting wooden window frames and more particularly to a guide for scraping excess stain or paint from the glass pane.

BACKGROUND OF THE INVENTION

Typically, wooden window installations are provided with frames having natural wood surfaces that enclose the glass panes. Generally, in preparing a wooden window installation, a pre-stain is first applied to the natural wood surfaces to present a uniform appearance. Manufactures generally require that interior finishing of the wood surfaces should be performed after installation. Ordinarily, the application of two coats of varnish, generally polyurethane, or two coats of paint are specified to protect natural wood surfaces. In the absence of the coats, wood surfaces will undergo discoloration and deterioration from sources such as moisture and fungal attack.

A finish coat is the last coat of paint or varnish to be applied. In order to form a water seal between the glass pane and the wood frame, the finish coat should overlap the glass pane 1/16 inch.

The finish coat is applied using an applicator such as a paint brush or a pad. The glass pane is shielded during the application of the finish coat. For instance, the glass pane is shielded using masking tape in order to prevent the paint or varnish from covering the window beyond the desired 1/16 inch overlap. Alternatively, an edger is used to prevent the paint or varnish from covering the window beyond the 1/16 inch overlap.

The shield (masking tape or edger), however, oftentimes allows paint to seep beneath it, resulting in a ragged or uneven edge. One of the more difficult tasks in finishing the window installation is forming a neat, uniform 1/16 inch overlap at the boundary between the wood frame and glass pane. Therefore, the final step for finishing the window requires scraping the excess finishing coat from the glass pane while leaving the 1/16 inch overlap between the wood frame and the glass pane.

Thus, it is desirable to provide a window scraper guide for scraping the excess paint or varnish from the glass pane while leaving a neat, uniform, even edge at the glass pane to the wood frame boundary.

SUMMARY OF THE INVENTION

An object of the present invention is to provide a new and improved device for guiding a scraper approximate the glass pane to the wood frame boundary.

Another object of the present invention is to provide a paint scraper guide for leaving a neat, uniform, even edge at the glass pane to the wood frame boundary.

Still another object of the present invention is to provide a paint scraper guide that will leave a predetermined overlap of varnish or paint on the glass pane at the glass pane to the wood frame boundary. Typically the predetermined overlap will be 1/16 inch, but could range from 1/64 inch to 1 inch.

This is achieved by a window scraper guide for shielding a pane to leave a predetermined overlap of varnish or paint on the pane at the pane to frame boundary.

The window scraper guide has a base with a first straight edge disposed between an upper surface and an opposing lower surface. A pair of sides extends perpendicularly rearward a first predetermined distance from the first straight edge. The distance between the upper surface and the opposing lower surface is a second predetermined distance. A side shield extends upwardly from one side of the pair of sides, and the side shield has a second straight edge aligned with the first straight edge. A handle portion extends at a predetermined angle from the lower surface of the base.

In use, the window scraper guide is held in one hand while a scraper is held in the other hand. The side shield is located on the side of the base corresponding to the hand. For example, if the window scraper guide is held in the left hand then the side shield is located at the left side. The first straight edge of the window scraper guide is placed on the boundary between the pane and the frame in such a manner that the first and second straight edges are in contact with the pane. Excess paint is scraped from the pane bounded by the first and second straight edges. The window scraper guide is then moved to the next section of window progressing in clockwise if held in the left hand and counterclockwise rotation if held in the right hand until the entire boundary is finished.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Figure 1:
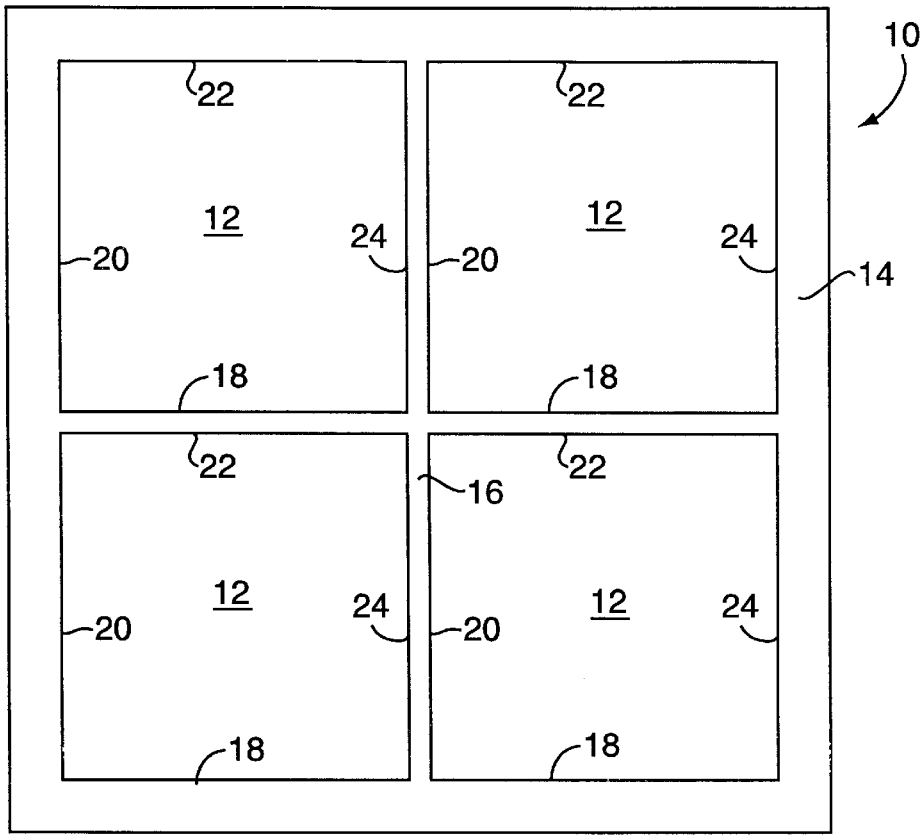
FIG. 1 is a cross sectional view of a window installation.

Referring to FIG. 1, a typical window assembly 10 is shown enclosing four glass panes 12. The window assembly consists of a wood frame 14, and glass panes 12 disposed within the frame. Although many wood frames enclose more than one glass pane, wood frames enclosing only one glass pane are well known. In the embodiment shown, interior wood frame 16 is positioned within the window assembly 10. The wood frames 14 and 16 encase the glass panes 12 and defines edge boundaries 18, 20, 22, 24 of the glass panes 12. When encased in the wood frames, a seal is formed between the edge of the glass pane and the wood frame by a compression fit at the points of contact. The compression fit may also be aided by the use of a filler-adhesive, such as putty, or other material as is well known in the art of window construction. The wood frames align and position the glass panes within the wood frames and provide lateral support to the glass panes.

Typically, when window assemblies 10 are delivered for installation, the wood frames 14, 16 are not finished and therefore require staining or painting. When the glass pane(s) 12 are encased within the wood frames upon delivery, the seal between the glass pane(s) and the wood frames is not exact and air leakage can occur. Therefore, when varnishing or painting the wood frame, it is useful to apply a 1/16 inch overlap of paint or varnish onto the glass pane at the edge boundary 18, 20, 22, 24 between the wood frame and the glass pane. The overlap should be ample enough to form a seal by adhering to both the glass pane and the wood frame. However, the overlap on the glass pane should be as small as practicable to maximize the glass pane view area and for aesthetics.

Figure 2:
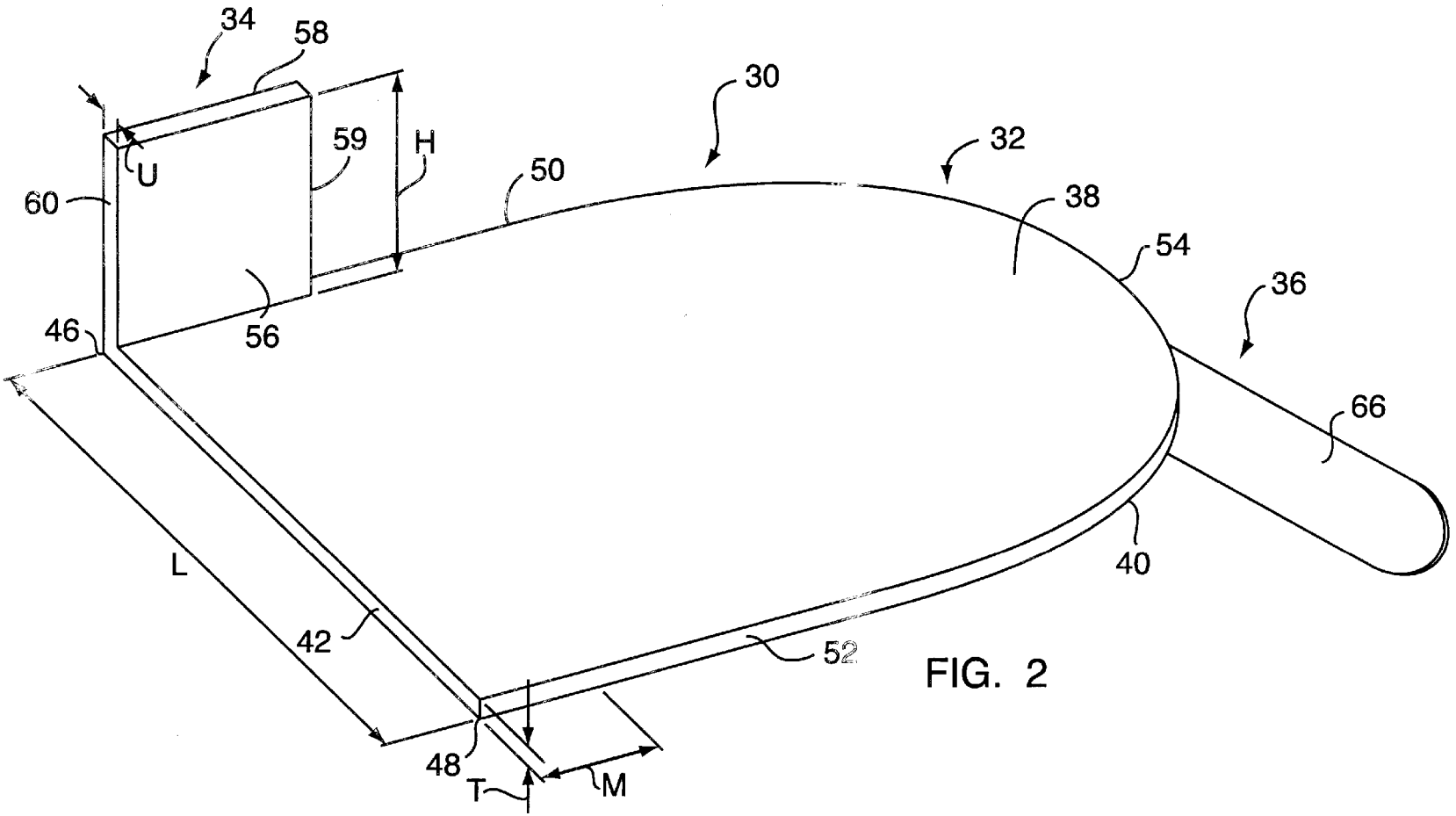
FIG. 2 is a generally perspective view of an exemplary embodiment of the invention.

Referring now to FIG. 2, a preferred embodiment of a window scraper guide, generally designated as 30, is shown. The guide includes a base 32, a side shield 34 and a handle portion 36.

The base includes an upper planar surface 38 and an opposing lower planar surface 40. The upper surface 38 is spaced a predetermined distance from the lower surface 40. A first straight edge 42 is formed between the upper surface and the lower surface. The distance between the upper surface and lower surface defines a thickness "T" of the first straight edge.

Figure 3:
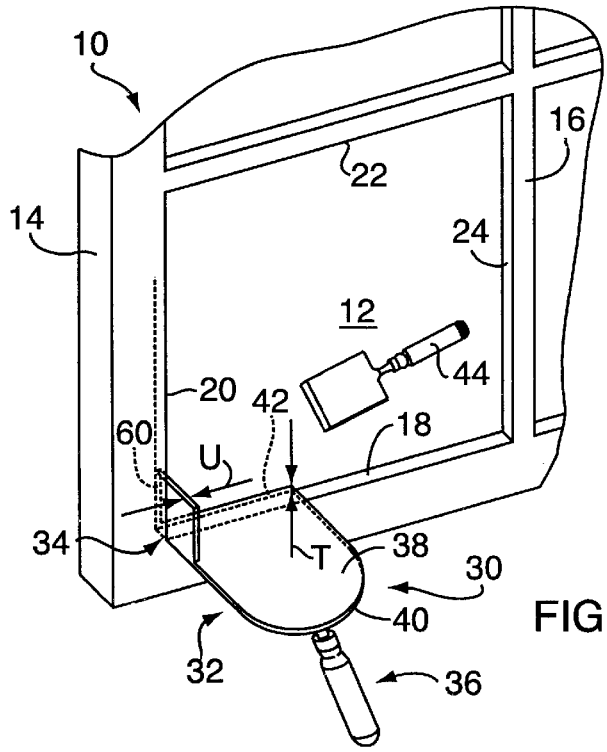
FIG. 3 is a generally perspective view of the invention of FIG. 2 aligned for use.

Referring to FIG. 3, the thickness "T" maintains separation between a scraper 44 and the wood frames 14, 16 when varnish or paint is being scraped from the glass pane 12. As indicated above, the thickness can vary between 1/64 inch and 1 inch, but is preferably about 1/16 inch.

Referring again to FIG. 2, the length of the first straight edge 42 is a predetermined length "L", the length "L" being less than the distance between either pair of opposing edge boundaries 20–24 and 18–22 of the glass pane 12 (See FIG. 1). The predetermined length "L" is for positioning the first straight edge in contiguous engagement with the glass pane 12 at the edge boundary 18, 20, 22, 24 chosen for forming an overlap when scraping the glass pane, to be described hereinbelow. As one skilled in the art would appreciate, the predetermined distance "L" should be long enough to form a shield for the scraper such that the glass pane can be scraped while the window scraper guide is placed at the chosen edge boundary thereby leaving an overlap of varnish or paint. A typical minimum length is at least two inches. However, a longer length will provide a larger working area. Therefore, optimally, the first straight edge 42 will be just slightly smaller than the length of the edge boundary chosen for forming the overlap. For instance 4 to 8 inches.

From each end 46 and 48 of the first straight edge 42, sides 50 and 52 extend perpendicularly rearward respectively a predetermined distance "M", for example 2 in. Left side 50 and right side 52 each define a perpendicular corner at the respective ends 46 and 48. The purpose of the perpendicular extension of the sides for a predetermined distance "M" is to provide contiguous contact of the first straight edge with the glass pane when the side 50, 52 is abutting the wood frame 14, 16. See FIG. 3.

In the particular embodiment shown, the sides 50 and 52 are parallel to each other and extend to an aft end 54. The aft end has a curved shape. One skilled in the art would appreciate that the aft end 54 can take many other forms including a straight edge, ellipse, or even a concave-convex combination.

The base 32 is constructed from a rigid, hard material in order to resist bending when the guide is being used with the scraper 44 and held by the handle portion 36. In the preferred embodiment, the base is made of metal such as iron or steel. The base can be formed by a method such as stamping or forging, which also imparts rigidity. Furthermore, it can be appreciated that the material forming the straight edge 42 and the material approximate the first straight edge may undergo heat treatment or alloying to further increase hardness. Hardness is desirable in order to resist wear caused by friction with the scraper.

It is to be further appreciated that the base can be formed from a rigid plastic material. When using plastic for the base, the straight edge is overlaid with a metal such as iron, steel or copper for additional wear resistance. Alternately, the first straight edge can be affixed between the upper and lower surfaces as is well known in the art.

The side shield 34 is composed with an inner planar surface 56, and an opposing outer planar surface 58. The inner planar surface is spaced a predetermined distance "U" from the outer planar surface. A second straight edge 60 is formed between the outer planar surface and the inner planar surface having a thickness "U". The predetermined distance "U" is identical to the predetermined thickness "T" of the base 32.

Again referring to FIG. 2, in the embodiment shown, the side shield 34 is positioned at right side 50, and extends perpendicularly upward from upper planar surface 38. The second straight edge 60 is flushly aligned with the first straight edge 42. When the first and second straight edges are placed on a flat glass pane there is complete contact between the straight edges and the glass pane. It can be appreciated that the side shield can extend from either the right side 50 or the left side 52.

The shape of the planar surfaces 56 and 58 of the side shield 34 is generally rectangular. The rectangular shape provides rigidity to the window scraper guide and aligns the window scraper guide with the edge boundary 18, 20, 22, 24 when in use. However, it is to be appreciated that an aft end 59 of the side shield can take other forms such as concave or convex.

Referring to FIG. 3, the distance "U" maintains separation between the scraper 44 and the wood frame 14, 16 when varnish or paint is being scraped from the glass pane 12.

Referring again to FIG. 2, the height of the second straight edge 60 is a predetermined distance "H". The distance "H" provides protection to the wood frame 14, 16 and provides a clearance equal to the predetermined distance "U." The predetermined height "H" is illustrated at three inches. But, it can be appreciated that the height "H" can range from less than an inch to a maximum height being less than the distance between either pair of opposing edge boundaries 20–24 and 18–22 of the glass pane 12 (See FIG. 1). However, a smaller height, of three inches is preferable in order to protect the boundary 18, 20, 22, 24 that will be positioned near the window scraper guide and to provide maneuverability while changing the position of the window scraper guide. Furthermore, when moving the window scraper guide to an adjacent boundary, the height "H" provides a clearance to the previously boundary as will be described hereinbelow. The side shield is manufactured from the same material as the base. In the present embodiment, the side shield is integrally formed with the base during the manufacturing process. However, it can be appreciated that the side shield can be formed from stock such as sheet metal and then affixed in position by welding, brazing or other commonly known process.

It is to be further appreciated that the side shield can be formed from a rigid plastic material. When using a material such as plastic for the side shield, the portion approximate the second straight edge can be made from a metal such as iron, steel or copper for additional wear resistance.

Figure 4:
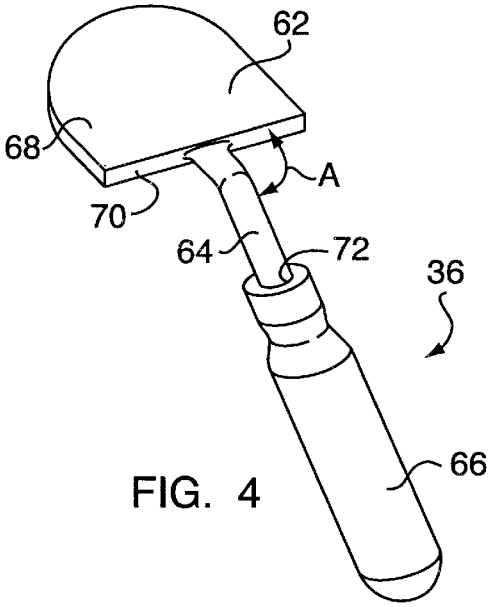
FIG. 4 is a plan view of the handle portion of the invention of FIG. 2.

Now, referring to FIG. 4, the handle portion 36 comprises a mounting tab 62 which forms an extension 64 protruding from the rear end 70 of the mounting tab. A handle 66 is axially mounted on the extension. The mounting tab has a first planar surface 68 for fixedly mounting the mounting tab 62 to the lower planar surface 40 of the base 32 (See FIG. 2). The mounting tab is affixed to the lower planar surface of the base approximate the aft end 54. When affixed to the lower planar surface the mounting tab is aligned an equal distance from sides 50 and 52.

The extension 64 extends angularly a predetermined distance generally one to six inches, from the rear end 70 of the mounting tab 62. The predetermined distance of the extension is for mounting the handle 66. A predetermined angle "A" of between 0 and 90 degrees, preferably 30 degrees is formed between the first planar surface 68 of the mounting tab and the extension 64. When the mounting tab is affixed to the lower planar surface 40 of the base, the extension extends angularly downward from the lower planar surface 40 of the base 32 and away from the first straight edge 42. Typically the mounting tab is mounted to the lower planar surface 40 by welding, bolting or similar method as is well-known in the art. The reason the extension is extended at angle "A" is to prevent interference with the user's arm holding the scraper and the user's other arm holding the guide.

The mounting tab 62 and extension 64 are manufactured from a material such as a rigid metal. For instance, steel, iron, bronze or other similar metal.

The generally cylindrical handle 66 is mounted on the extension 64 for holding the window scraper guide. A bore 72 extends partially through the axis of the handle. The diameter of the bore is slightly smaller than the width of the extension thereby being adapted to be inserted over the extension 64 and retained in place by contact compression with the extension. The length of the handle is at least as long as the extension and is generally between 3 to 9 inches, preferably 6 inches. The handle can be attached by other methods that are well known in the art. For instance, through the use of epoxy glue or pins. The handle is typically made from a material such as wood or plastic. The handle is used to hold the window scraper guide.

Figure 5:
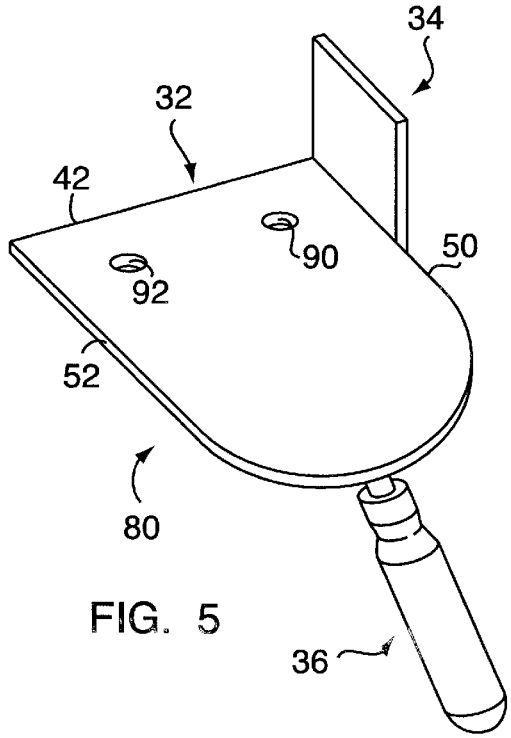
FIG. 5 is a generally perspective view of another exemplary embodiment of the invention.

Referring to FIG. 5, a second embodiment of the window scraper guide is shown generally at 80. The window scraper guide consists of a base 32, a side shield 34 and a handle portion 36. The second embodiment of the window scraper guide is identical to the first embodiment described hereinabove except for the side shield and means for attaching the side shield as will be described hereinbelow. In the second embodiment the side shield is removably mounted at either side 50 or 52.

Figure 6:
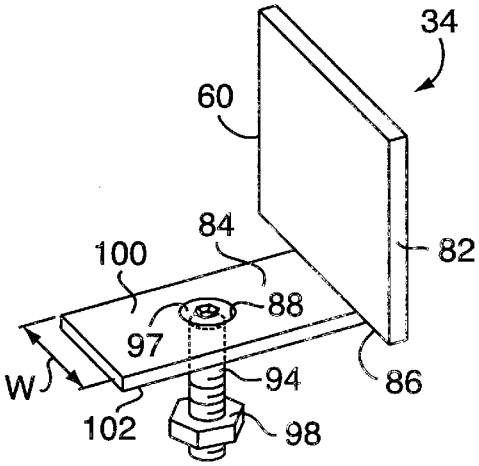
FIG. 6 is a generally perspective view of the side shield of the invention corresponding to FIG. 5.

Referring to FIG. 6, the side shield 34 of the second embodiment will now be described. The side shield 34 comprises a second straight edge 60 and a third straight edge 82. The distance between the second and third straight edges is at least 3 inches and preferably at least 4 inches. When assembled the second straight edge or the third straight edge is alternately mounted flush with the first straight edge 42 of the base as will be described hereinbelow. (See FIG. 5.)

A mounting strip 84 extends perpendicular from the plane formed by second and third straight edges 60, 82, from a lower edge 86 of the side shield 34. The width "W" of the mounting strip is between ⅜" to ½". A ¼ hole 88 extends from the upper surface 100 to the lower surface 102 of the mounting strip. As shown, the diameter of the hole is adapted to accept a ¼" bolt 94. However, it can be appreciated that other diameters for other bolt sizes could be selected.

Figure 7:
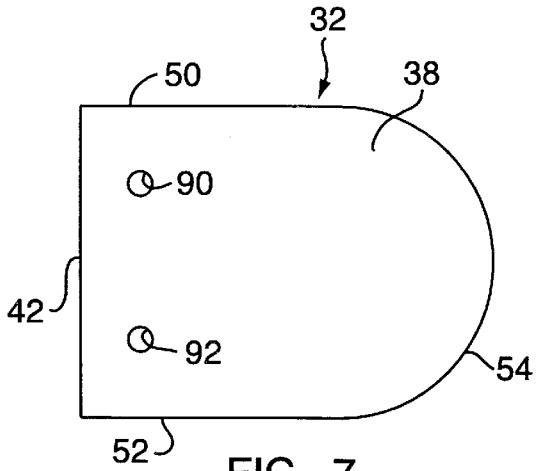
FIG. 7 is a plan view of the base of the invention corresponding to FIG. 6.

Referring now to FIGS. 5 and 7, two holes 90 and 92 extend through the upper and lower planar surfaces 38, 40 of the base 32. The diameter of holes is adapted to receive the ¼" bolt 94. Each hole 90, 92 is positioned between one-half and two inches, preferably three-quarters of an inch from its respective side 50, 52. The holes are positioned such that when the hole 88 of the mounting strip is aligned with the bolt passing through either hole 90 or 92 in the base 32, the side shield will be positioned with either the second straight edge 60 or third straight edge 82 aligned with the first straight edge 42. Thus, the side shield can be positioned on either side 50, 52 of the base. One can appreciate that when assembled on the base 32, an edge 96 of the mounting strip is at least 1.25 inches from the first straight edge 42 of the base 32. Therefore, the mounting strip will not contact the window frame when aligning the window scraper guide against the glass pane 12 (See FIG. 3). As can be appreciated, the mounting strip can be positioned further from the front edge by changing the hereinbefore described dimensions of the side shield 34, the mounting strip 84 and positions of holes 90 and 92.

The bolt 94 has a flat head 97. The predetermined length of the bolt is between ¼" and ½". The flat head presents a minimal aspect to prevent interference with the operation of scraping as will be described hereinbelow. The predetermined length of the bolt is sufficient to pass through the upper and lower surfaces and engage a nut 98. The length of the bolt is preferably just sufficient to engage the nut in order to prevent interference with the operation of scraping.

The mounting strip 84 is affixed to the base 32 with the bolt 94 and the nut 98. The bolt is inserted from the upper planar surface 38 and the mounting strip 84 is placed on the lower planar surface 40 with the bolt inserted therethrough. The nut 98 threadedly engages the bolt to retain the side shield 34 in place at the preselected edge.

Referring to FIG. 3, the operation of the window pane scraper guide will now be described. First, the finishing coat of varnish or paint is applied to the wood frame 14 while applying an overlap of 1/16 inch to the glass pane 12. This will typically result in an overlap that is nonuniform extending from the frame more than 1/16 in. The window scraper guide 30 is held in the selected hand of the user. Here, for the purposes of the example, the left hand use will be described with the side shield positioned at left side 52. If the guide is held in the right hand then the side shield will be positioned at right side 50. The scraper will be held in the hand which is not holding the guide.

The first straight edge 42 of the window scraper guide 30 is aligned at the lower boundary 18 between the window pane 12 and the wooden frame 14. The side shield 34 is aligned with the vertical boundary 20 between the window pane and the wooden frame. The first straight edge is then placed on the boundary 18 with the upper and lower planar surfaces 38, 40 held perpendicular to the window pane. The side shield is thereby aligned perpendicularly with the vertical boundary 20. The placement of the window scraper guide as described provides a working area within the first and second straight edges 42, 60 to scrape excess paint or varnish. The thickness of the first and second straight edges masks the overlapped paint or varnish to the extent that the first and second straight edges cover the paint or varnish.

Next, the paint or varnish is scraped using the scraper 44. When the excess paint has been removed, the user moves the window pane scraper guide over to the next section of the boundary. Assuming a clockwise progression, the window scraper guide is then placed on the next boundary 20. Because the paint or varnish has been removed outside of 1/16 overlap masked by the side shield, the window scraper guide does not have to be flush with the boundary 18 of the frame and the side of the window scraper guide is displaced from the boundary 18 by a distance equal to the height "H" of the side shield. Continuing in clockwise progress, the entire overlap from boundary 20 is scrapped and scraping progresses to boundary 22 and thence to boundary 24 and finally to the un-scraped portion of boundary 18. One can appreciate that this description also applies to a counter-clockwise progression having the window scraper guide is held in the right hand.

An advantage of the present invention is that it provides a device for shielding a pane along a glass pane boundary. Another advantage of the present invention is that it is used with a scraper to form a neat, uniform, even edge at the glass pane to wood frame boundaries. Still another object of the present invention is that will leave a predetermined overlap of varnish or paint on the glass pane at the glass pane to wood frame boundaries. Typically the predetermined overlap will be 1/16 inch.

While the preferred embodiments have been shown and described, various modifications and substitutions may be made thereto without departing from the spirit and scope of the present invention. Accordingly, it is to be understood that the present invention has been described by way of illustration and not limitation.

What is claimed is:

1. A window scraper guide for shielding a pane to leave a predetermined overlap of varnish or paint on a pane to frame boundary comprising:

(a) a base having a first straight edge disposed between a first surface and an opposing second surface, and a pair of sides extending perpendicularly a first predetermined distance from the first straight edge, the distance between the first surface and the opposing second surface being a second predetermined distance;

(b) a side shield extending upwardly from one side of the pair of sides, the side shield having a second straight edge intersecting the first straight edge; and (c) a handle portion extending at a predetermined angle from the second surface of the base wherein the base and the side shield are made from plastic.

2. The window scraper guide of claim 1 wherein the base and the side shield are made from plastic and the first straight edge and the second straight edge are made from metal.

3. A window scraper guide for shielding a pane to leave a predetermined overlap of varnish or paint on a pane to frame boundary comprising:

(a) a base having a first straight edge disposed between a first surface and an opposing second surface, and a pair of sides extending perpendicularly a first predetermined distance from the first straight edge, the distance between the first surface and the opposing second surface being a second predetermined distance;

(b) a side shield extending upwardly from one side of the pair of sides, the side shield having a second straight edge intersecting the first straight edge; and (c) a handle portion extending at a predetermined angle from the second surface of the base; wherein the base includes at least one hole extending from a first surface through a second surface; the side shield includes a third straight edge and a mounting strip extending from a first edge of the side shield; the mounting strip includes a hole disposed on a first surface of the mounting strip extending through a second surface of the mounting strip; the hole on the mounting strip is aligned with at least one hole of the base being retained in place by a bolt passing therethrough, the bolt engaging a nut; and either the second straight edge or the third straight edge intersecting with the first straight edge.

4. A window scraper guide for shielding a pane to leave a predetermined overlap of varnish or paint on a pane at a pane to frame boundary comprising:

(a) a base having a first straight edge disposed between a first surface and an opposing second surface, and a pair of sides extending perpendicularly a first predetermined distance from the first straight edge, the distance between the first surface and opposing second surface being a second predetermined distance; and (b) a side shield extending upwardly from and partially down one side of the pair of sides, the side shield having a second straight edge intersecting the first straight edge.

5. The window scraper guide of claim 4, wherein the first straight edge is between 1/64 in. and 1.0 in.

6. The window scraper of claim 4 wherein a handle projects outwardly from the second surface of the base.

7. A window scraper guide for shielding a pane to leave a predetermined overlap of varnish or paint on a pane at a pane to frame boundary comprising:

(a) a base having a first straight edge disposed between a first surface and an opposing second surface, and a pair of sides extending perpendicularly a first predetermined distance from the first straight edge, the distance between the first surface and opposing second surface being a second predetermined distance; and (b) a side shield extending upwardly from one side of the pair of sides, the side shield having a second straight edge intersecting the first straight edge wherein the base and the side shield are made from plastic.

8. A window scraper guide for shielding a pane to leave a predetermined overlap of varnish or paint on a pane at a pane to frame boundary comprising:

(a) a base having a first straight edge disposed between a first surface and an opposing second surface, and a pair of sides extending perpendicularly a first predetermined distance from the first straight edge, the distance between the first surface and opposing second surface being a second predetermined distance; and (b) a side shield extending upwardly from one side of the pair of sides, the side shield having a second straight edge intersecting the first straight edge wherein the base and the side shield are made from plastic and the first straight edge and the second straight edge are made from metal.

* * * * *